United States Patent [19]

Sheppard

[11] 4,204,812

[45] May 27, 1980

[54] VACUUM SYSTEM

[75] Inventor: William L. Sheppard, Romulus, Mich.

[73] Assignee: AVM Corporation, Jamestown, N.Y.

[21] Appl. No.: 880,285

[22] Filed: Feb. 22, 1978

[51] Int. Cl.[2] ..... F04B 45/00; F01L 21/04

[52] U.S. Cl. ..... 417/395; 91/229

[58] Field of Search ..... 417/395, 392, 391, 402; 91/342, 224, 229; 60/397, 411

[56] References Cited

U.S. PATENT DOCUMENTS

| | | | |
|---|---|---|---|
| 983,729 | 2/1911 | Laidley | 417/395 |
| 2,597,059 | 5/1952 | Bitzer | 417/395 |
| 3,131,640 | 5/1964 | Rohde et al. | 417/392 |
| 3,294,030 | 12/1966 | Fox | 417/395 X |
| 3,514,226 | 5/1970 | Wood | 417/392 |
| 3,605,556 | 9/1971 | Erdmann | 91/229 X |
| 3,749,527 | 7/1973 | Slagle | 417/395 |

*Primary Examiner*—Leonard E. Smith

*Attorney, Agent, or Firm*—Harness, Dickey & Pierce

[57] ABSTRACT

Disclosed is a vacuum pump device that is adapted to create a vacuum source from a source of high pressure air. The device comprises a piston actuated in one direction by compressed air and in the opposite direction by a power return spring. The compressed air moves the piston to load the spring and the spring moves the piston to create a vacuum. A special dumping valve is also provided which is actuated toward the end of the return stroke of the piston to cause a sudden increase in the pressure differential across the piston to prevent stalling of the piston when loading is such that the piston moves very slowly, thereby assuring that the vacuum pump will cycle as often as is necessary to maintain the desired vacuum.

23 Claims, 6 Drawing Figures

3
3
4
4
5
5
10
12
40
42
43
44
45
46
48
49
52
53
54
55
56
57
58
59
60
61
62
64
65
68
70
72
76
78
79
80
82
88
91
92
94
95
97
99
100
101
103
105

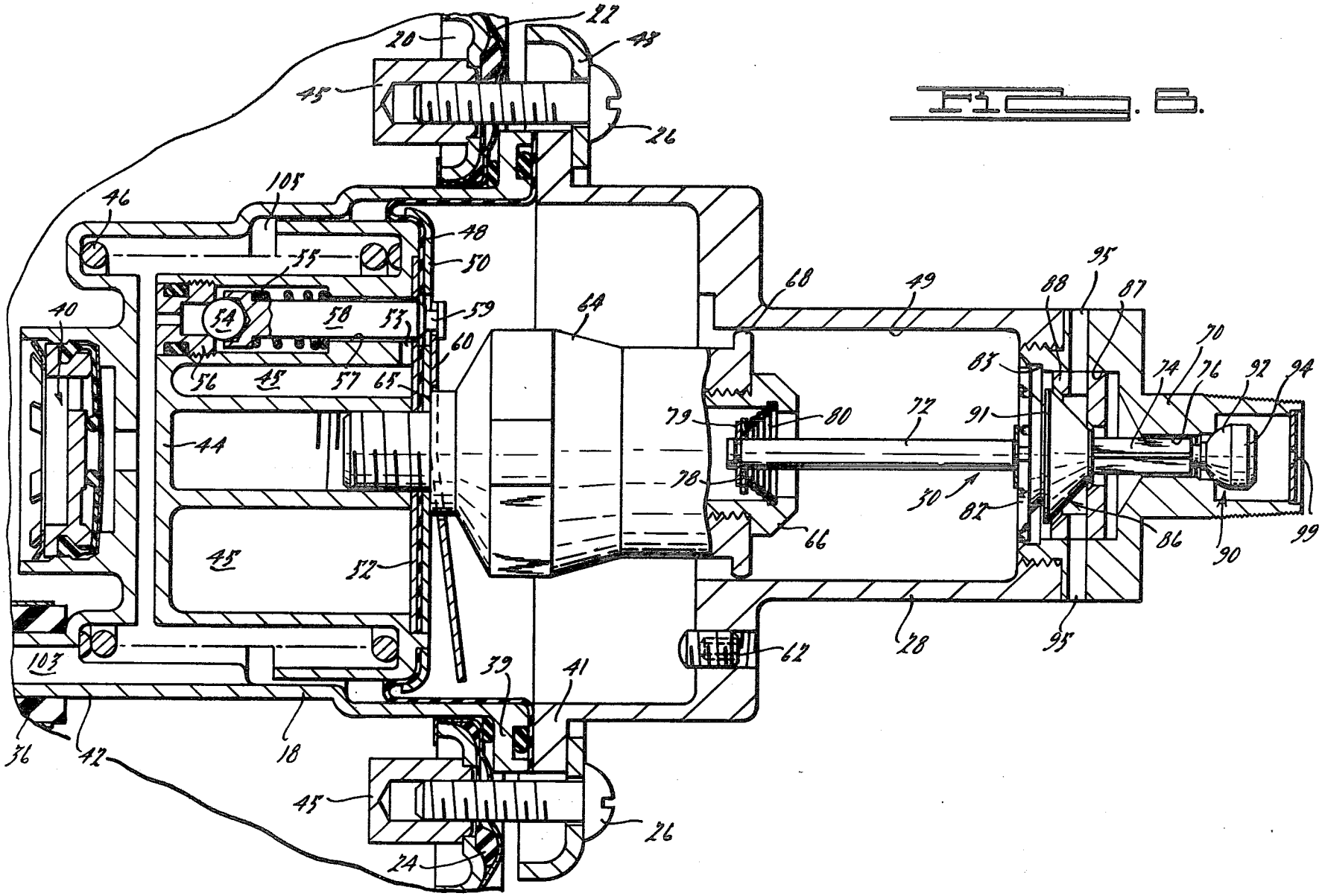

VACUUM SYSTEM

BACKGROUND AND SUMMARY OF THE INVENTION

The present invention relates to a vacuum pump and in particular to a device that is capable of creating a source of vacuum from a source of compressed air.

Frequently the situation arises where there exists an abundant supply of compressed air but a shortage of vacuum pressure. This situation typically occurs in trucks, and especially those which are diesel powered. Since many of the accessory devices installed on trucks are vacuum actuated, the need for an adequate supply of vacuum pressure can be readily appreciated. The present invention is particularly suited for such applications, because of its ability to generate as much vacuum pressure as is required to actuate a particular vacuum load. In addition, the construction of the vacuum pump according to the present invention is designed to be relatively inexpensive, so as not to add significantly to the cost of the vehicle.

Generally speaking, the vacuum pump comprises a single acting piston that is adapted to draw air from a vacuum load into a vacuum reservoir under the power of a power return spring that is cocked by the piston during its compressed-air-actuated power stroke. The pump is adapted to cycle as often as is necessary to satisfy the demand of the vacuum load. Stalling in very slow movement modes of operation is prevented by a unique dumping valve arrangement that is adapted to cause a sudden increase in the pressure differential across the piston at the end of the piston's return stroke. A valve train assembly comprising an inlet valve and an exhaust valve is provided which is actuated at the termination of the piston stroke in each direction. The valve train assembly controls the input and exhaust of the compressed air which powers the piston on its power stroke.

Additional objects and advantages of the present invention will become apparent from the following detailed description of the preferred embodiment which makes reference to the following drawings.

BRIEF DESCRIPTION OF THE DRAWINGS

FIG. 6 is a view of the vacuum pump similar to that of FIG. 2 showing the piston at the end of its power stroke.

DETAILED DESCRIPTION OF THE PREFERRED EMBODIMENT

Figure 1:
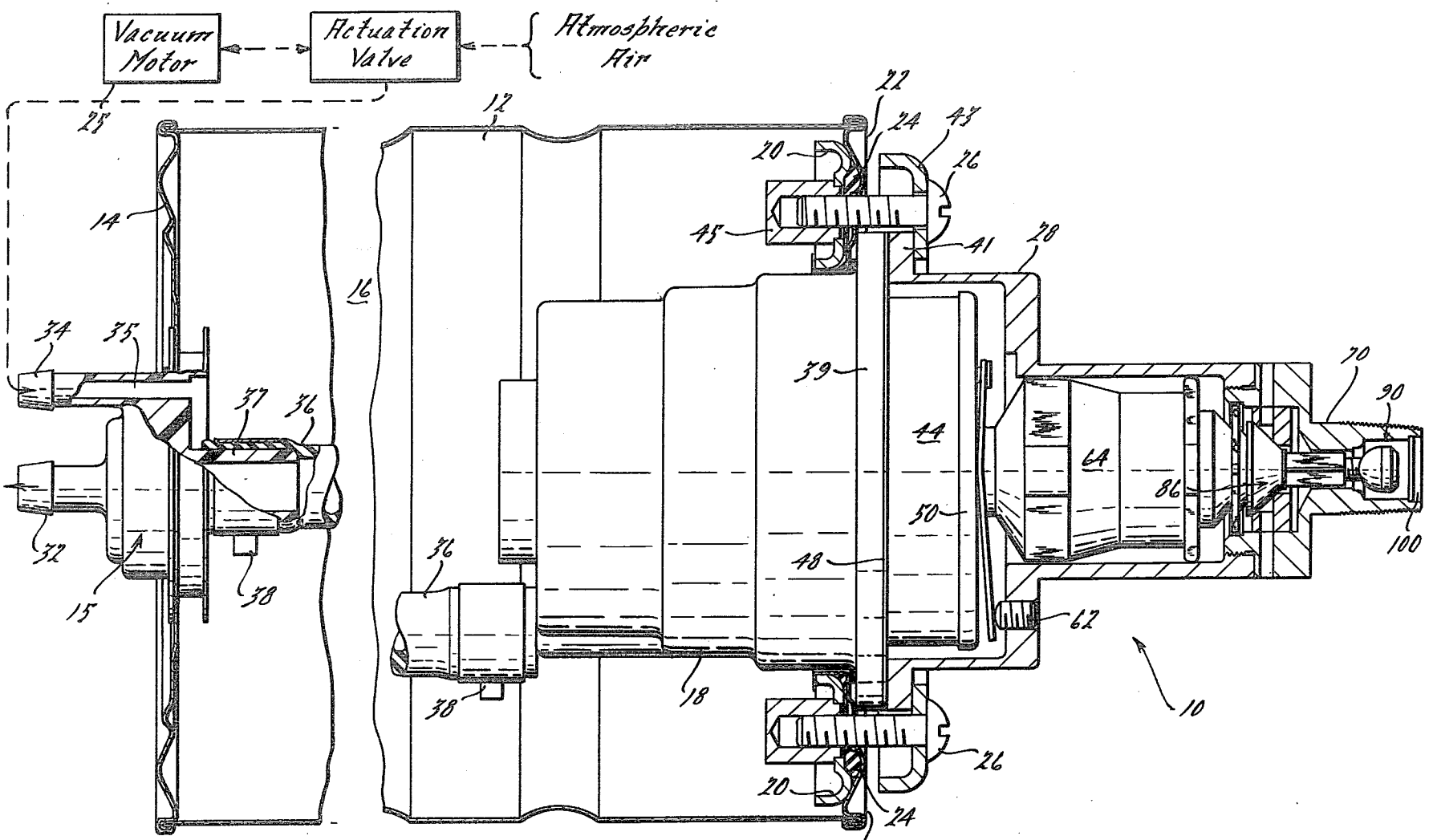
FIG. 1 is a partial longitudinal sectional view of a vacuum pump device according to the present invention.
Figure 2:
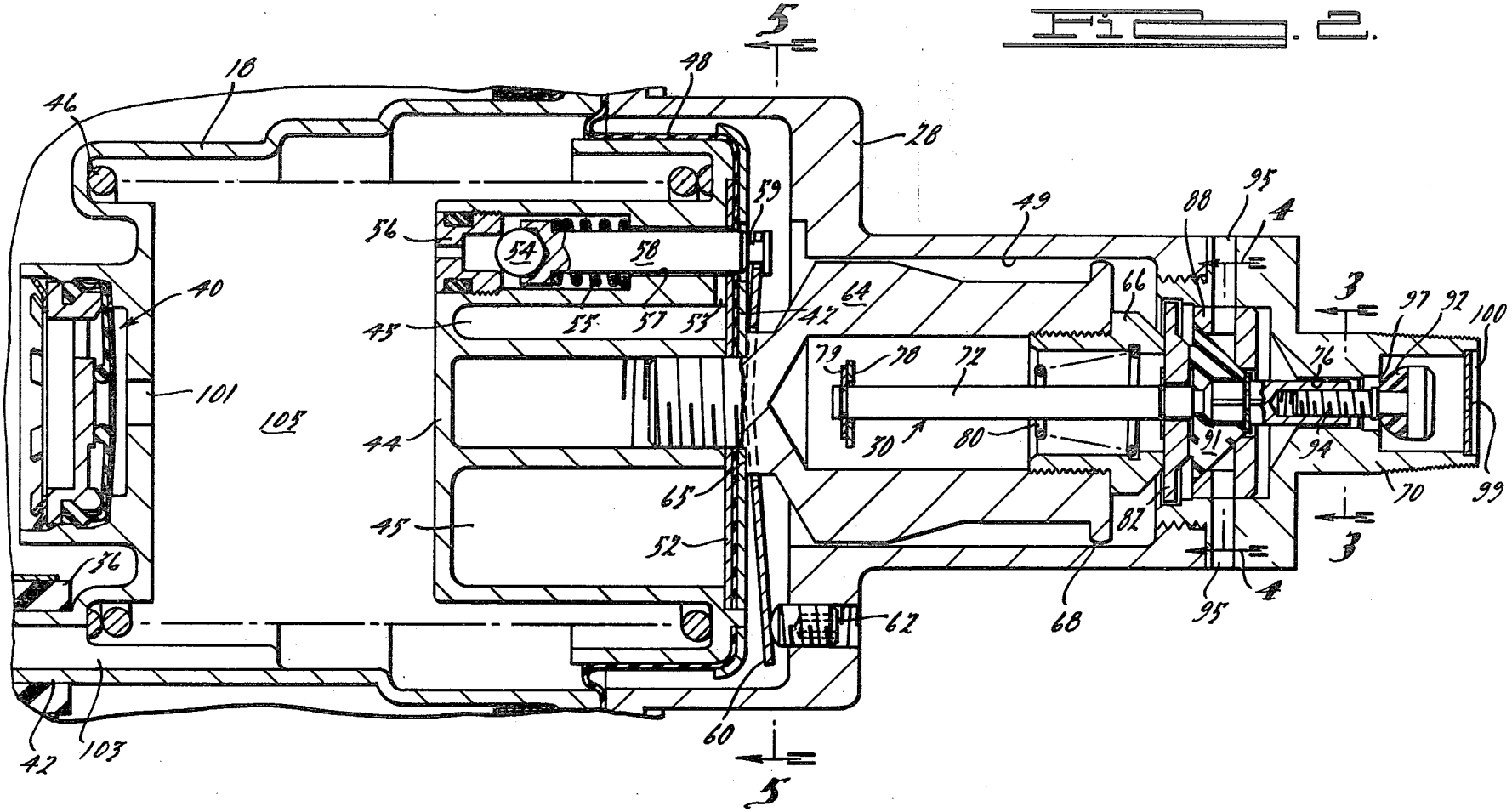
FIG. 2 is an enlarged longitudinal sectional view showing the piston, valve train, and power valve assemblies of the vacuum pump shown in FIG. 1, with the piston at the end of its return stroke.

Referring to FIGS. 1 and 2, a vacuum pump device 10 according to the present invention is shown, comprising generally a housing or can 12 having a pump exhaust valve 15 at one end, and a pump assembly at the opposite end including a piston housing 18 having an exterially extending bonnet 28, the free end of which is closed by a valve seat member 70 which is threadably attached thereto. The pump assembly has an internal cavity having a first inlet 100, a second inlet 101 controlled by a check valve 40, an outlet 103, and has disposed therein a reciprocating piston 44, a power return spring 46, a rolling lobe diaphragm 48 and an independently movable valve train assembly 30 supported by an axially disposed and movable shaft 72. Can 12 is cylindrically-shaped, similar to an ordinary coffee can, having ribbed side walls to increase the strength thereof. The ends of can 12 are enclosed, in part, by a pair of lids 14 and 22 which may be secured in the usual manner (e.g., a rolled seam) to the side walls of can 12 so as to form an air-tight seal. Lids 14 and 22 may also be ribbed to increase their integrity. The interior volume of can 12 defines a primary reservoir 16 of vacuum pump 10.

Sealingly mounted in any suitable manner in an opening in lid 14 is pump exhaust check valve 15. Exhaust valve 15 is a one-way check valve similar to that described in U.S. Pat. No. 3,827,456, issued Aug. 6, 1974, which description is incorporated herein by reference. Check valve 15 is contained within a molded plastic casing 35 having two external nipples 32 and 34 protruding from the end of can 12. First nipple 32 communicates with check valve 15 and provides an air exhaust for the pump. Nipple 34 communicates directly with primary reservoir 16 within can 12 via passageway 35, and is adapted to be connected to a vacuum load 25, such as a diaphragm motor, to be operated by vacuum pump 10. The vacuum motor is controlled in the usual manner by an actuating valve which places the motor in fluid communication with the vacuum pump in the "on" position and in communication with the atmosphere when in the "off" position. The motor also directly communicates with the atmosphere in the usual manner. The internal side of check valve 15 is connected to an exhaust hose 36, which is secured to an inlet nipple 37 on the check valve by a hose clamp 38. Exhaust hose 36 extends substantially the length of can 12 and is secured at its opposite end by another hose clamp 38 to an exhaust outlet nipple 42 on piston housing 18, which is fastened to lid 22 at the opposite end of can 12. Nipple 42 communicates with outlet 103. As is more fully described in the above-referenced patent, check valve 15 is adapted to permit air to pass in the direction of the arrow (out exhaust nipple 32) when the pressure of the air on the inlet side of the valve at nipple 37 is greater than the pressure on the outlet side. Check valve 15, however, will not permit air to pass in the reverse direction when the opposite pressure differential condition exists.

As best seen in FIGS. 1 and 6, housing 18 extends through a central opening in lid 22 and is provided with an outwardly projecting bonnet 28. Both the housing and bonnet may be molded out of a suitable plastic and in order to mount same housing 18 is provided with an annular flange 39 which generally abuts a corresponding annular flange 41 on bonnet 28. The respective parts are clamped together in a sealing manner both with respect to each other and to lid 22 by means of an annular externally disposed clamping ring 43 and an internally disposed annular nut ring 20 having affixed thereto, as by brazing, a plurality of metal nut elements 45. Clamp ring 43 is provided with apertures aligned with nut elements 45 and the assembly is held together by means of a plurality of threaded fasteners 26 threadably engaging the nut elements. In order to prevent leakage through the fastener apertures, there is provided an annular elastomeric sealing gasket 24 having O-ring type seals along its inner and outer peripheries and an intermediate web portion having suitable apertures through which the fasteners pass. The O-ring like configurations at the peripheries of the gasket are compressed between the inner surface of lid 22 and nut ring 20 to provide the requisite seal.

The end of the cavity within piston housing 18 and disposed to the left of diaphragm 48, as viewed in FIGS. 2 and 6, acts as a pumping chamber and is indicated at 105. Inlet 101 of chamber 105 is sealed by check valve 40 which is similar to pump exhaust check valve 15. Check valve 40 is a one-way check valve adapted to permit air to pass from primary reservoir 16 into chamber 105 when the air pressure within the primary reservoir 16 is greater than the pressure within chamber 105. Check valve 40 will not permit air to pass in the reverse direction when the opposite pressure differential condition exists.

Piston 44 is of the single acting type, and is adapted to move on its power stroke from the position illustrated in FIG. 2 to the position illustrated in FIG. 6 upon the application of compressed air through inlet 100. The power stroke of piston 44 compresses return spring 46, which is disposed on the exhaust side of the piston between it and the end of housing 18. Power return spring 46 returns piston 44 to the position illustrated in FIG. 2 upon the actuation of vacuum load 25 connected to the pump 10 or until an equilibrium pressure is reached. The specific manner in which piston 44 is cycled will be more fully explained in connection with the description of the overall operation of the vacuum pump. Piston 44 may be molded from plastic and is generally hollow, having an internal cavity constituting an annular secondary reservoir 45 which is closed by an annular member 52. Pumping chamber 105 is sealed from the input side of the piston by rolling lobe diaphragm 48 which is secured to the head of piston 44 between member 52 and a retainer 50. Threadably secured to and extending outwardly from the head of piston 44 is an extension member 64 that projects into a bore 49 in bonnet 28. Member 64 is generally square in cross-section, whereas bore 49 is circular, thereby providing for fluid flow therebetween. A guide surface 68, also generally square and having a maximum dimension slightly smaller than the inside diameter of bore 49, is located at the end of extension member 64 to provide a guide for the movement of piston 44. Retainer 50 is caused to clamp against diaphragm 48 by a shoulder 65 on member 64. Threadably secured to the end of extension member 64 is a threaded element 66 having a through bore in which is retained a tapered coil buffer spring 80, adapted to engage a washer 78 affixed to the inner end of shaft 72 by a snap ring 79, when piston 44 approaches the end of its power stroke as illustrated in FIG. 6.

Secondary reservoir 45 communicates with pumping chamber 105 via a passage 53, bore 57 and a dumping valve 54 disposed within piston 44. Dumping valve 54 is secured to a valve stem 58 adapted to actuate the dumping valve against the bias of a valve spring 55. Valve spring 55 maintains dumping valve 54 normally in its closed position against its valve seat 56. Valve stem 58 loosely extends through bore 57 in piston 44 and through diaphragm 48 where it is connected to an angled lever 60 in the manner best shown in FIGS. 2 and 5. Lever 60 is adapted to pivot against retainer 50 and actuate dumping valve 54 when the free end of lever 60 contacts an adjustable actuating screw 62. Screw 60 is threadably engaged in a threaded opening through bonnet 28 and is adapted to be preset so that it will contact lever 60 at the appropriate point in the cycle. The specific function of the dumping valve assembly, lever 60, and screw 62 will also be more fully explained in connection with the description of the overall operation of the vacuum pump.

Figure 3:
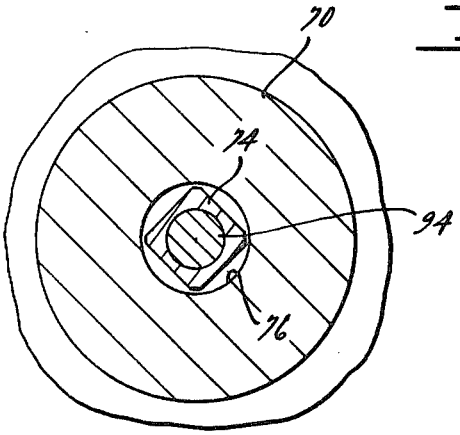
FIG. 3 is a sectional view of the vacuum pump of FIG. 2 taken along line 3—3.
Figure 4:
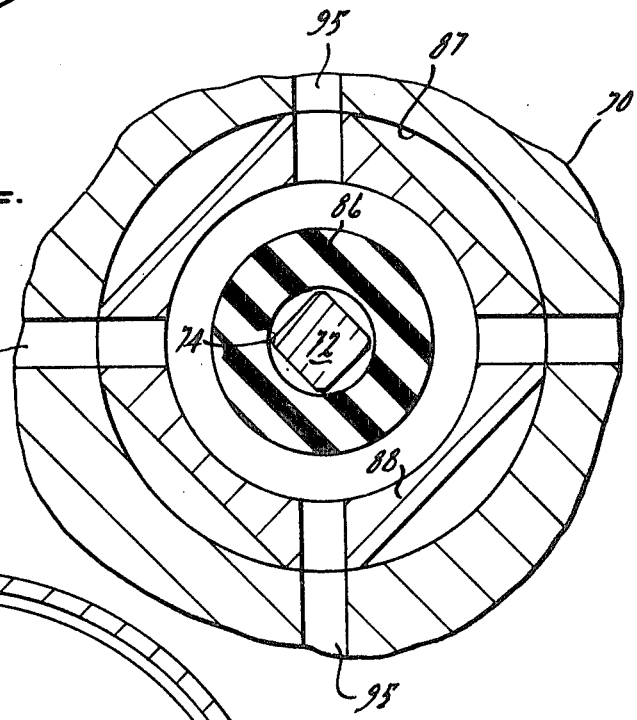
FIG. 4 is a sectional view of the vacuum pump of FIG. 2 taken along line 4—4.

Shaft 72 forms the core of valve train assembly 30, which generally includes an exhaust valve 86 and a power valve 90. As best seen in FIGS. 2, 3 and 6, the outer end 74 of shaft 72 is generally square in cross-section and is slidably supported in a circular bore 76 in seat member 70, whereby fluid may flow therebetween. Seat member 70 is threadably secured to bonnet 28. Exhaust valve 86 comprises an elastomeric truncated conical shaped valve 91 affixed to shaft 72 and adapted to form an air-tight seal with an exhaust valve seat 88 when piston 44 is at the end of its return stroke, as illustrated in FIG. 2. As can be seen, seat 88 has two axially spaced conical surfaces adapted to be sealingly engaged by valve 91. Exhaust valve 86 controls the venting of compressed air through a plurality of exhaust vents 95, as best shown in FIGS. 4 and 6. Exhaust valve seat 88 fits into a circular counter bore 87 in valve seat member 70 and is generally square in external configuration in order to provide fluid passageways therebetween. As can be seen in FIG. 4, these passageways do not communicate with vents 95. Closing movement of the exhaust valve is limited by the engagement of a stop member 82 affixed to shaft 72 and a circular annular shoulder 83 on seat member 70, thus preventing damage to the exhaust valve if urged closed with excessive force (e.g., by power return spring 48). Stop member 82 is generally square in cross-section so fluid can flow between it and seat member 70.

Power valve 90 comprises a spherical elastomeric valve 92 affixed to the end of shaft 72 by a suitably threaded fastener 94 and adapted to sealingly engage annular valve seat 97 at the end of bore 76 in power valve seat 70. An orifice 99 is fitted over inlet 100 to smooth out the pressure of the compressed air supplied to inlet 100. The respective parts are positioned so that when the exhaust valve is open the power valve is closed, and vice versa.

Valve train assembly 30 is adapted to operate independently of the movement of piston 44 except at the ends of the piston stroke. Specifically, at the end of the piston power stroke, as shown in FIG. 6, buffer spring 80 will contact washer 78 to move shaft 72 to the left as shown to cause exhaust valve 86 to open and power valve 90 to close. Conversely, at the end of the piston return stroke, as illustrated in FIG. 2, the end surface of element 66 will engage stop member 82 to move shaft 72 to the right as shown to cause exhaust valve 86 to close and power valve 90 to open.

The operation of vacuum pump 10 according to the present invention is as follows. Assuming the device is initially in the position illustrated in FIG. 2, high pressure air introduced at inlet 100 will act directly upon diaphragm 48 on the head of piston 44 causing it to move rapidly to the end of its power stroke against the bias of power spring 46, to the position illustrated in FIG. 6. During the power stroke of piston 44, the air in pumping chamber 105 is forced out nipple 32 of exhaust check valve 15 via exhaust outlet 103 and exhaust hose 36. No leakage occurs through exhaust valve 86 because it is closed. It is maintained closed by the pressure of the compressed air in the housing during the power stroke acting on the inside of the exhaust valve (i.e., the area difference between the larger inner seat and the smaller outer seat). As piston 44 approaches the end of its power stroke, buffer spring 80 engages washer 78 causing the valve train assembly to move in the direction of piston 44, thereby closing power valve 90 and opening the exhaust valve. Buffer spring 80 must be capable of transmitting sufficient force to overcome the net opposing exhaust valve closing force (i.e., that created by the air pressure acting on the aforesaid differential valve area). When power valve 90 closes, the piston stroke is terminated. The valve train assembly is held in this position by the force of the compressed air maintained at inlet 100 and acting upon the closed power valve. If the motor actuating valve is closed (so that air cannot flow into primary reservoir 16 via passageway 35), spring 46 will cause piston 44 to move to the right a sufficient distance to create a vacuum in the pumping chamber, and in primary reservoir 16 via check valve 40 and inlet 101, which balances the force of the spring. This may take several cycles of the pump, depending on how close the vacuum is to the design capacity of the pump. Air to the right of the piston as shown may exhaust through vents 95.

Cycling of the pump occurs automatically as piston 44 returns to its initial position under the force of power spring 46. This is accomplished by insuring that piston 44 does not stall as it approaches the end of its return stroke, before element 66 engages member 82 to actuate valve train assembly 30 to its FIG. 2 position in which compressed air moves the piston to the left on its power stroke. In the absence of dumping valve 54, this stalling could occur in certain loading conditions. For example, applicant's prototype pumps are capable of holding 12" Hg. vacuum and require a vacuum drop of approximately ½" Hg. in order to cycle; i.e., when the vacuum drops to 11½" Hg., such as would occur upon actuation of the vacuum motor, the piston will normally have completed its return stroke to actuate the valve train. However, in some situations the ½" Hg. drop may occur over a long period of time (i.e., many hours) as a result of which return movement of the piston will be so slow that it could cause power valve 90 to crack open without fully closing exhaust valve 86, as a consequence of which inlet compressed air will leak directly to the exhaust. This possible stalling is prevented by dumping valve 54, which is designed to cause a sudden reduction in the differential pressure across the piston just prior to its engaging the valve train, the effect of which is to suddenly accelerate the return movement of the piston to cause it to forcefully open the power valve and close the exhaust with a minimum loss of compressed air.

Figure 5:
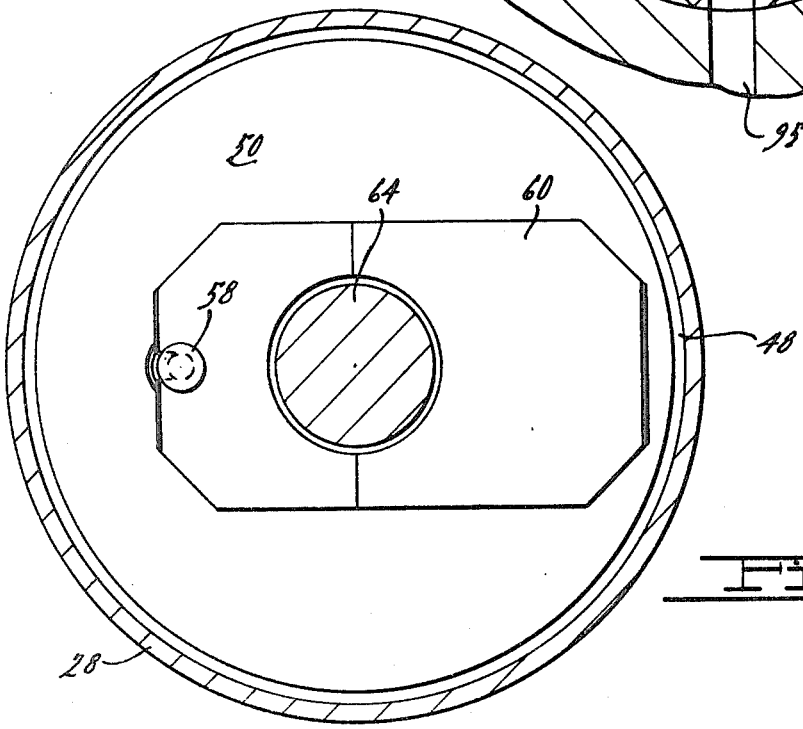
FIG. 5 is a sectional view of the vacuum pump of FIG. 2 taken along line 5—5.

The dumping valve functions as follows. Adjustment screw 62 is set so that just prior to element 66 contacting member 82, lever 60 will contact adjustment screw 62. Further movement of piston 44 will thus cause lever 60 to pivot against diaphragm support 50, thereby actuating valve stem 58 and opening dumping valve 54. As is best shown in FIG. 5, lever 60 comprises a rocker plate that is slotted at one end and is adapted to fit into a groove 59 in valve stem 58. As dumping valve 54 is opened, air from secondary reservoir 45 within piston 44 is vented to the vacuum side 47 of piston 44 causing a sudden reduction in the pressure differential across the piston. Since an airtight seal is not formed around valve stem 58 where it extends through annular member 52 and diaphragm 48, compressed air will leak into secondary reservoir 45 during the power stroke of piston 44. However, because the leakage path is small (it may be controlled by the size of the hole in member 52 through which the stem passes), leakage of air back to the input side of the piston when the exhaust valve 86 is open is relatively slow. Accordingly, depending upon how rapidly piston 44 is cycled, when dumping valve 54 is opened on the return stroke of piston 44 the pressure of the air in secondary reservoir 45 will be somewhere between atmospheric pressure and the pressure level of the input compressed air. Thus, since the pressure in primary reservoir 16 is less than atmospheric, the change in the pressure differential across the piston created by the opening of dumping valve 54 causes the piston to lurch the final distance to the end of its return stroke, thereby insuring positive actuation of valve train assembly 30. It will be noted that the operation of dumping valve 54 is regenerative in the sense that the more the dumping valve is opened, the greater the change in the pressure differential across piston 44, which in turn encourages further movement of piston 44 and causes dumping valve 54 to be opened further. The actuation of valve train assembly 30 at the end of the piston return stroke closes exhaust valve 86 and opens power valve 90 to recycle the pump. The cycle described will automatically be repeated as many times as necessary until the pressure in the primary reservoir equals the design vacuum for the pump and the piston is in equilibrium.

While the above describes the preferred embodiment of the invention, it will be appreciated that the invention is susceptible to modification, variation and change without departing from the proper scope or fair meaning of the accompanying claims.

I claim:

1. A vacuum device, comprising:

a pump housing having a first inlet adapted to be placed in fluid communication with a source of compressed air and a second inlet adapted to be placed in fluid communication with a vacuum actuated load;

a piston in said pump housing arranged to be powered in a power stroke direction by compressed air supplied to said first inlet, said piston defining a pumping chamber in said housing between said piston and said second inlet;

a return spring biasing said piston in the opposite return stroke direction, said piston and spring being arranged so that said spring biases said piston in a direction to cause it to draw air into said pumping chamber through said second inlet; and means responsive to the position of said piston to assist said return spring in completing the return stroke of said piston as it approaches the end thereof.

2. The vacuum device of claim 1, further including input valve means for controlling the supply of compressed air at said first inlet, and a first exhaust outlet having first exhaust valve means for controlling the exhaust of compressed air during the return stroke of said piston.

3. The vacuum device of claim 2, further including means for automatically closing said input valve means and opening said first exhaust valve means as said piston approaches the end of its power stroke.

4. The vacuum device of claim 2, further including means for automatically opening said input valve means and closing said first exhaust valve means as said piston approaches the end of its return stroke.

5. The vacuum device of claim 1, further including a second exhaust outlet in fluid communication with said pumping chamber, and second exhaust valve means in said second exhaust outlet for exhausting air to the atmosphere from said pumping chamber during the power stroke of said piston, and blocking the flow of air from atmosphere to said pumping chamber during the return stroke of said piston.

6. The vacuum device of claim 5, further including input valve means for permitting air to flow from said vacuum load through said second inlet into said pumping chamber only during the return stroke of said piston.

7. The vacuum device of claim 6, further including a cylindrically-shaped can defining a reservoir, and having said second exhaust valve mounted on one end wall of said can and said pump housing mounted on the other end wall of said can.

8. A vacuum device, comprising:

a pump housing having a first inlet adapted to be placed in fluid communication with a source of compressed air and a second inlet adapted to be placed in fluid communication with a vacuum actuated load;

a piston in said pump housing arranged to be powered in a power stroke direction by compressed air supplied to said first inlet, said piston defining a pumping chamber in said housing between said piston and said second inlet;

a return spring biasing said piston in the opposite return stroke direction, said piston and spring being arranged so that said spring biases said piston in a direction to cause it to draw air into said pumping chamber through said second inlet; and dumping valve means for causing an abrupt change in the pressure differential across said piston as said piston approaches the end of its return stroke under the force of said spring to assist said spring in moving said piston to complete said return stroke.

9. The vacuum device of claim 8, wherein said dumping valve means increases the pressure in said pumping chamber, and further comprising actuation means for actuating said dumping valve means as said piston approaches the end of its return stroke.

10. The vacuum device of claim 9, wherein said actuation means operates in response to the position of said piston.

11. The vacuum device of claim 9, further including a secondary reservoir in said piston in fluid communication with said pumping chamber via said dumping valve means, and in restricted communication with said source of high pressure air during the power stroke of said piston.

12. The vacuum device of claim 11, further including a rolling lobe diaphragm mounted between the head of said piston and said pump housing for providing an airtight seal between said pumping chamber and said first inlet.

13. The vacuum device of claim 12, wherein said dumping valve includes a valve stem that extends through the head of said piston and said diaphragm and connects to said actuation means, said diaphragm forming a nonairtight seal around said valve stem so that compressed air is permitted to leak into said secondary reservoir around said valve stem during said power stroke.

14. A vacuum device, comprising:

a pump housing having a first inlet adapted to be placed in fluid communication with a source of compressed air and a second inlet adapted to be placed in fluid communication with a vacuum actuated load;

a piston in said pump housing arranged to be powered in a power stroke direction by compressed air supplied to said first inlet, said piston defining a pumping chamber in said housing between said piston and said second inlet;

a return spring biasing said piston in the opposite return stroke direction, said piston and spring being arranged so that said spring biases said piston in a direction to cause it to draw air into said pumping chamber through said second inlet;

input valve means for controlling the supply of compressed air at said first inlet;

an exhaust outlet having exhaust valve means for controlling the exhaust of compressed air from said housing during the return stroke of said piston;

control means for automatically opening said input valve means and closing said exhaust valve means in response to movement of said piston to the end of its return stroke; and dumping valve means for causing an abrupt change in the pressure differential across said piston as said piston approaches the end of its return stroke under the force of said spring to assist said spring in moving said piston to complete said return stroke and actuate said control means.

15. The vacuum device of claim 14, further including a cylindrically-shaped can defining a reservoir, said housing being mounted in one wall of said can, said second inlet being in fluid communication with said reservoir.

16. The vacuum device of claim 14, wherein said piston has an internal reservoir in restricted fluid communication with said source of compressed air during said power stroke of said piston, said dumping valve means placing said reservoir in fluid communication with said pumping chamber when actuated.

17. The vacuum device of claim 14, further comprising adjustable stop means on said housing adapted to engage and actuate said dumping valve means.

18. The vacuum device of claim 17, wherein said dumping valve includes a valve, a valve stem and a lever connected to said valve stem and arranged to engage said stop means.

19. The vacuum device of claim 14, wherein said control means includes a valve stem movable in said housing independently of said piston, said input valve means and said exhaust valve means being mounted on said valve stem.

20. The vacuum device of claim 19, wherein said input valve means and said exhaust valve means are rigidly mounted to prevent movement of one relative to the other.

21. The vacuum device of claim 19, wherein said exhaust valve means is maintained open and said input valve means closed during said return stroke of said piston by the force created by said source of compressed air acting on said input valve means.

22. The vacuum device of claim 19, wherein said piston engages said valve stem as it approaches each end of its stroke to actuate both said valve means.

23. The vacuum device of claim 22, further comprising a spring on said piston positioned to engage said valve stem as said piston approaches the end of its power stroke to permit limited relative movement of said valve stem and piston after said valve means have been actuated.

* * * * *